US006754940B1

(12) United States Patent
Boots

(10) Patent No.: US 6,754,940 B1
(45) Date of Patent: Jun. 29, 2004

(54) CUSTOM CASKET HAVING REMOVABLE KEEPSAKES

(76) Inventor: Robert J. Boots, P.O. Box 715, Piqua, OH (US) 45356

( * ) Notice: Subject to any disclaimer, the term of this patent is extended or adjusted under 35 U.S.C. 154(b) by 0 days.

(21) Appl. No.: 10/327,458

(22) Filed: Dec. 20, 2002

(51) Int. Cl.[7] ..... A61G 17/00
(52) U.S. Cl. ..... 27/27; 16/439
(58) Field of Search ..... 27/27, 35, 2; 16/438, 16/439, DIG. 40, DIG. 41

(56) References Cited

U.S. PATENT DOCUMENTS

| | | | | | |
|---|---|---|---|---|---|
| 846,545 | A | * | 3/1907 | Bremer | 16/439 |
| 2,023,211 | A | * | 12/1935 | Scholl et al. | 16/439 |
| 2,330,141 | A | * | 9/1943 | Olson | 16/439 |
| 2,334,682 | A | * | 11/1943 | Sidi | 16/439 |
| 3,204,286 | A | * | 9/1965 | Hillenbrand | 16/439 |
| 4,068,347 | A | * | 1/1978 | Johnson et al. | 16/438 |
| 4,077,096 | A | * | 3/1978 | Christian | 27/2 |
| 4,615,085 | A | * | 10/1986 | Hartman | 27/1 |
| 5,309,614 | A | * | 5/1994 | MacKirdy | 27/10 |
| 5,377,395 | A | * | 1/1995 | Maier et al. | 27/2 |
| 5,463,800 | A | * | 11/1995 | Rojdev | 27/1 |
| 5,519,923 | A | | 5/1996 | Rojdev et al. | |
| 5,727,291 | A | | 3/1998 | Biondo et al. | |
| 5,898,980 | A | | 5/1999 | Havranek et al. | |
| 6,094,789 | A | | 8/2000 | Hankel et al. | |
| 6,145,175 | A | | 11/2000 | Enneking et al. | |
| 6,499,193 | B1 | * | 12/2002 | Robert | 16/445 |

* cited by examiner

*Primary Examiner*—William L. Miller
(74) *Attorney, Agent, or Firm*—C. John Brannon; Daniel L. Boots; Bingham McHale LLP

(57) ABSTRACT

A combination of a casket and reattachably removable hardware for lifting the casket, including an aperture formed through a casket sidewall, a generally circular plate defined between a first radius and a second radius, an elongated lifting member having a first end, an internally threaded cavity formed in the first end, and an externally threaded connecting member. The plate is positioned adjacent the aperture and when the externally threaded connecting member extends through the aperture, the first end of said elongated lifting member rotatably removably engages the connecting member to detachably connect the elongated lifting member to the casket.

14 Claims, 4 Drawing Sheets

CUSTOM CASKET HAVING REMOVABLE KEEPSAKES

BACKGROUND OF THE INVENTION

In response to a growing demand, there is a trend in the funeral industry to provide increasingly customized caskets. Although somewhat limited by the functionality of the casket design, the aesthetic appearance of a casket may be effected significantly by the choice of materials, lid and wall contour, escutcheon plate selection, interior lid artwork and the like. The appearance of the casket goes beyond its mere aesthetic value to become the basis for the final memories the funeral party may have of the departed. Further, since funerals are typically costly events that occur during times of financial upheaval, customization of the casket should be done as efficiently as possible.

On a more personal level, for the pallbearer, carrying the casket is the final service to be performed on behalf of the departed. Known casket designs include either fixed or pivoting side handrails that are gripped by the pallbearers when the casket is carried. These handrails extend along the length of either side of the casket and contribute additional weight to the casket. Since pallbearing is often a very emotional task, it is desirable to make the burden of carrying the casket as easy as possible, both physically and emotionally.

Moreover, the final disposition of most caskets is either burial or cremation. When a casket is cremated, most of the metal pieces, such as the decorative trim and handrails, are first removed so as to avoid searing bone fragments and the like to the heated metal. It is customary for the casket, once scaled, to remain closed; thus, removal of the hand rails and other metal pieces is usually accomplished through the use of a saw or torch, effectively destroying the removed metal pieces. Likewise, when a casket is buried, the decorative metal trim and handrails are buried along with it and are thus effectively lost or destroyed. In either case, the aesthetic and sentimental value of the casket is forever lost.

There thus remains a need for efficient and cost-effective casket customization. Additionally, there remains a need for reducing the mass of metallic trim remaining on the casket, both for carrying by the pallbearers and for final disposition. Further, there remains a need to reduce the emotional strain on the pallbearers. The present invention addresses such needs.

SUMMARY OF THE INVENTION

The present invention relates to a casket-lifting assembly removably attachable to a casket sidewall and externally removable at a gravesite without requiring the opening of the casket. The casket-lifting assembly includes an aperture formed through the casket sidewall, an elongated member having a threaded end, and a threaded connector rotatably matable to the threaded end and positioned adjacent the aperture. When the threaded end is passed through the aperture the threaded connector rotatably engages the threaded end to couple the elongated member to the casket. Once coupled to the casket, the elongated member may be rotatably decoupled from the casket without opening the casket.

One object of the present invention is to provide an improved casket-lifting assembly. Related objects and advantages of the present invention will be apparent from the following description.

DESCRIPTION OF THE PREFERRED EMBODIMENTS

Figure 1:
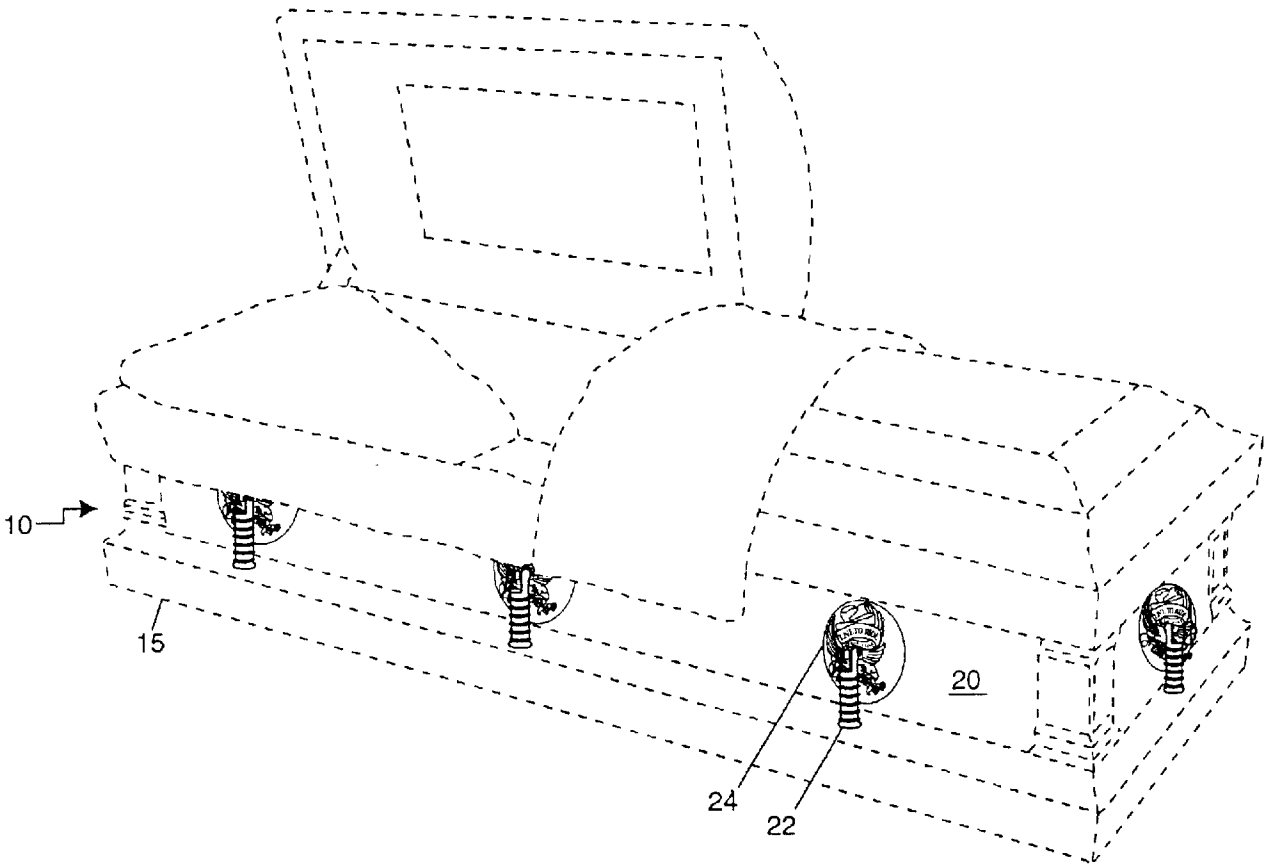
FIG. 1 is a perspective view of a casket equipped with a first embodiment of the casket-lifting assembly of the present invention.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

Figure 2:
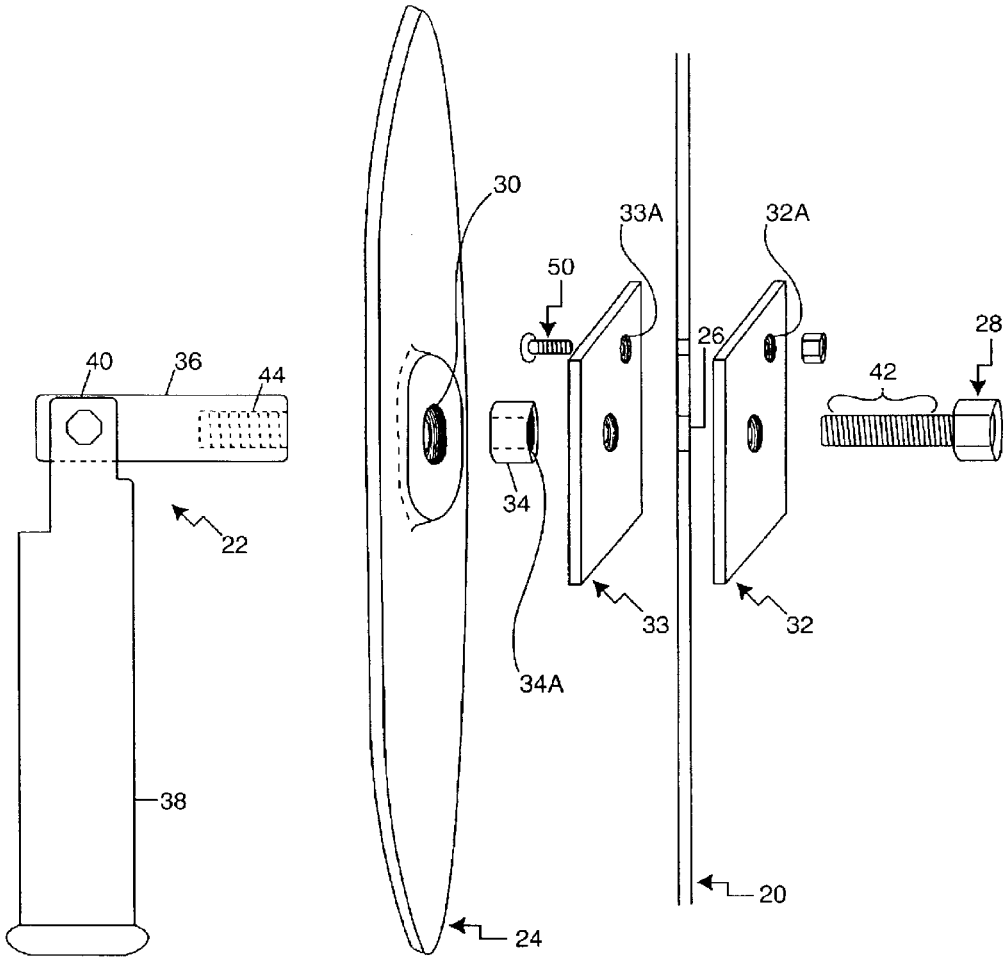
FIG. 2 is an exploded perspective view of the casket-lifting assembly of FIG. 1.
Figure 3A:
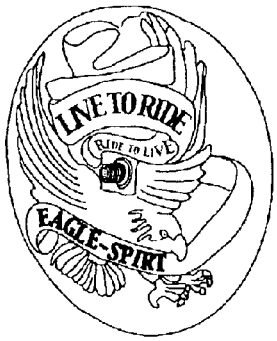
FIG. 3A is a partial exterior view of the casket assembly of FIG. 1 showing showing a threaded connecting member protruding from the casket sidewall.
Figure 3B:
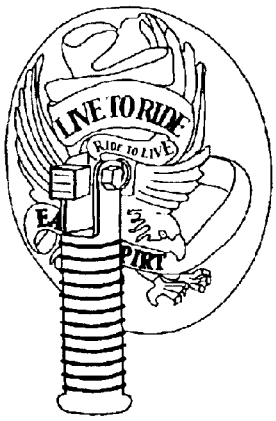
FIG. 3B is a partial exterior view of the casket assembly of FIG. 1 showing a connected handle in a first position.
Figure 3C:
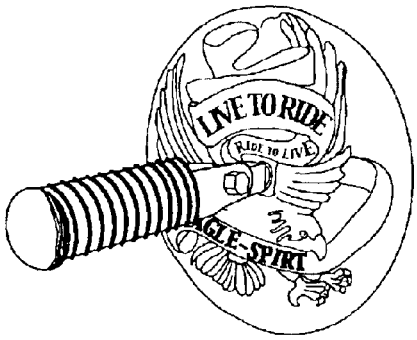
FIG. 3C is a partial exterior view of the casket assembly of FIG. 1 showing a connected handle in a second position.
Figure 4:
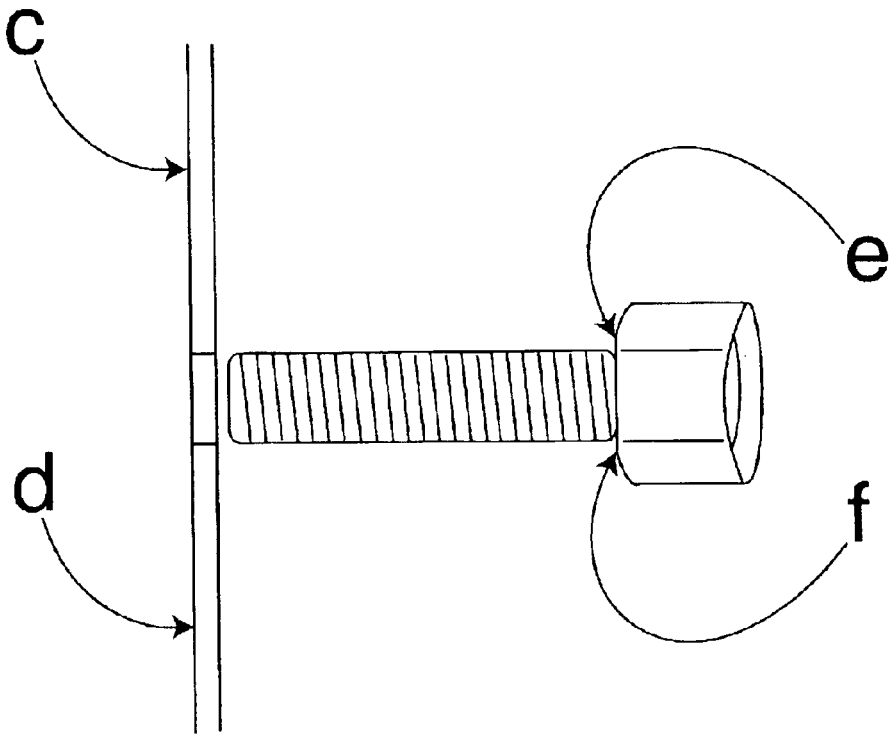
FIG. 4 is an exploded isolated view of an alternate embodiment connector portion and reinforcing plate of FIG. 1.

FIGS. 1 and 2 relate to a first embodiment of the present invention, an externally removable lifting assembly 10 for attachment to a casket 15 through the casket sidewall 20. The assembly 10 includes a handle member 22, an escutcheon or trim plate 24, an aperture 26 formed in the casket sidewall 20 and a first connecting member 28. The handle member 22 is preferably a substantially linear elongated member. More preferably, handle member 22 is a motorcycle part, and still more preferably the handle member 22 is a motorcycle foot peg assembly.

The trim plate 24 preferably has an opening or aperture 30 formed therethrough, and more preferably the trim plate aperture 30 is about the same size as the casket sidewall aperture 26. The trim plate 24 may alternatively be generally donut shaped, i.e. being defined between a first and second radius, where the second radius exceeds the first radius in length. The assembly may further include reinforcing plates 32 for positioning on either side of the sidewall aperture 26 and a spacer 34.

As seen in FIGS. 2 and 3A–3C, the handle member 22 further includes a connector portion 36 and a second handgrip portion 38. Preferably, connector portion 36 and handgrip portion 38 are pivotally joined at a joint 40. More preferably, the handgrip 38 portion is adapted to pivot between a first position substantially collinear with connector portion 36 and a second position substantially perpendicular to connector portion 36. The handle assembly is installed such that it folds downwardly to the second vertical portion when not in use. When in use, the handgrip portion 38 is pulled upwardly to its first horizontal position as shown in phantom in FIG. 2 to enable the casket to be carried. To that end, handgrip portion 38 should not pivot upwardly past its horizontal casket-carrying position.

Connector portion 36 preferably includes an interlocking portion 44 adapted to matingly or lockingly engage the first connecting member 28. Preferably, the first connecting member 28 includes external or male threads 42 and the interlocking portion 44 is defined by a threaded female cavity adapted to removably threadingly or matingly engage the first connecting member 28. In other words, the first connecting member 28 preferably screws into and unscrews out of the interlocking portion 44 of connector portion 36. Alternately, first connecting member 28 may be female-threaded and the interlocking portion 44 may be male-threaded. Likewise, the first and second connectors 28, 44 may be chosen as any convenient connector pairs known in the art.

During assembly, connecting member 28 and first reinforcing plate 32 are positioned within the casket sidewall 20 such that member 28 extends through the aperture 32*a* of first reinforcing plate 32 and aperture 26 of the casket sidewall (see FIG. 2). Portion 42 of connecting member 28 is sized smaller than apertures 26 and 32A so as to be able to pass therethrough while portion 28' of member 28 is larger than aperture 26 so as to be unable to pass therethrough. Prior to completing the assembly of this invention by affixing handle member 22, connecting member 28 must somehow be fixed to avoid rotating so as to be capable of threadably receiving handle portion 22. Were member 28 not fixed but allowed to rotate, it would spin freely when the user attempts to threadably disengage (unscrew) the handle portion 22 from the exterior of the casket. Member 28 can be fixed in position by a variety of conventional means.

In a currently preferred embodiment of the invention, the first reinforcing plate 32 is connected to the interior side of the casket wall 20 by mechanical connector 50. Mechanical connector 50 is illustrated as a machine screw-hex nut combination with the machine screw extending through reinforcing plate 32 and casket side wall 26 and held fast in place by a hex nut. In alternate embodiments, mechanical connector 50 could be any convenient mechanical connection device. Member 28 is affixed to reinforcement plate 32 via a spot weld. Alternately, metal epoxy may simply be applied at points c and d of the first reinforcing plate 32 to affix plate 32 to the interior side of the casket wall 20, and at points e and f on member 28 to affix member 28 to reinforcement plate 32 (see FIG. 5). Care must be taken to apply sufficient glue to adhere the pieces together.

Once connecting member 28 is affixed in place with threaded portion 42 extending through apertures 32A and 26, second reinforcement plate 33 and spacer 34 receive threaded portion 42 through openings 33A and 34A, respectively. In a preferred embodiment, trim plate 24 may be placed coaxially over spacer 34 as the outer diameter of spacer 34 is smaller than the interior diameter of aperture 30 of the trim plate. Once the trim plate 24 is in a place, handle assembly 22 may be threadably attached, via its connector portion 44, to connector member 28 at threaded portion 42. When fully assembled, spacer 34 is preferably snug at one end adjacent the exterior surface of the second or exterior reinforcement plate 33 and snug at its other end adjacent interlocking portion 44 of handle assembly 22. The length of spacer 34 is preferably chosen such that interlocking portion 44 of handle 22 is also flush against the outside of the trim plate 24. Preferably, interlocking portion 44 is slightly radiused, such that the end 36*a* of the handle is flush against the outside surface of spacer 34 and slightly below the outer surface of the trim plate 24. Radiusing the handle 22 thus reduces stress on the trim plate 24 during lifting of the casket 20 while adding to its aesthetic value.

The connecting member 28 lockingly receives the second connector portion 44 of the casket-penetrating portion 36 to secure the handle member 22 to the casket sidewall 20. In the preferred embodiment, this is done by rotating the handle member 22 such that the external male threads 42 of the first connecting member 28 interlockingly or threadedly engage the female threaded cavity 44 of the connecting portion 36. Likewise, handle member 22 may be disengaged from the casket 15 by counter-rotating the handle member 22 to disengage the connecting portion 36 from the first connecting member 28.

Once the casket is moved to its final location at the grave site, the handle assembly 22 may be threadably removed from the casket whereby the pall bearers or others may take the handle portion 22 home as keepsakes from the funeral. Trim plate or insert 24, which may bear indicia or an inscription remembering the departed if desired, may also be taken home as a keepsake.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nearly infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A combination of a casket and reattachably removable hardware for lifting the casket, comprising:

a casket sidewall having a first aperture formed therethrough;

a trim plate having a second aperture formed therethrough;

a handle member having a first pivotable portion and a second connector portion;

a female threaded recess formed in the second connector portion of said handle member; and a male screw member fixed positioned within the casket sidewall generally adjacent the aperture and threaded to matingly engage the female threaded recess of said handle member;

wherein the handle member is removably engagable to the male screw member.

2. The combination of claim 1 wherein the male screw member extends through the casket sidewall and protrudes therefrom.

3. The combination of claim 1 wherein the male screw member is recessed in the casket sidewall.

4. The combination of claim 1 wherein the male screw member is rotationally anchored relative to the casket sidewall.

5. The combination of claim 1 further comprising a first reinforcing plate connected between the trim plate and the casket sidewall.

6. The combination of claim 5 further comprising a second reinforcing plate connected to the casket sidewall substantially opposite the first reinforcing plate.

7. The combination of claim 6 further comprising a mechanical connector extending through the first reinforcing plate, the second reinforcing plate, and the casket sidewall.

8. The combination of claim 1 wherein the handle member is a motorcycle foot peg.

9. A combination of a casket and reattachably removable hardware for lifting the casket, comprising:

an aperture formed through a casket sidewall;

a generally circular plate defined between a first radius and a second radius;

an elongated lifting member having a first end;

an internally threaded cavity formed in the first end; and an externally threaded connecting member;

wherein the plate is positioned adjacent the aperture; and wherein when the externally threaded connecting member extends through the aperture, the first end of said elongated lifting member rotatably removably engages the connecting member to detachably connect the elongated lifting member to the casket.

10. The combination of claim 9 wherein the externally threaded member is rotationally anchored relative to the sidewall.

11. The combination of claim 9 further comprising a reinforcing plate member fixedly attached to both the externally threaded member and to the casket sidewall.

12. The combination of claim 11 wherein the reinforcing plate member is welded to the externally threaded member.

13. The combination of claim 12 wherein the reinforcing plate member is bolted to the casket sidewall.

14. The combination of claim 13 wherein the elongated lifting member is a motorcycle foot peg.

* * * * *